US011688270B2

(12) United States Patent
Chua

(10) Patent No.: US 11,688,270 B2
(45) Date of Patent: Jun. 27, 2023

(54) MOBILE MONITORING SYSTEM, MOBILE MONITORING UNIT, AND MOBILE MONITORING METHOD

(71) Applicant: CONCORDE ASIA PTE. LTD., Singapore (SG)

(72) Inventor: Swee Kheng Chua, Singapore (SG)

(73) Assignee: CONCORDE ASIA PTE, LTD., Singapore (SG)

( * ) Notice: Subject to any disclaimer, the term of this patent is extended or adjusted under 35 U.S.C. 154(b) by 212 days.

(21) Appl. No.: 17/059,447

(22) PCT Filed: May 29, 2018

(86) PCT No.: PCT/SG2018/050263
§ 371 (c)(1),
(2) Date: Nov. 29, 2020

(87) PCT Pub. No.: WO2019/231391
PCT Pub. Date: Dec. 5, 2019

(65) Prior Publication Data

US 2021/0233379 A1 Jul. 29, 2021

(51) Int. Cl.
*G08B 25/00* (2006.01)
*G08B 25/10* (2006.01)

(52) U.S. Cl.
CPC ..... *G08B 25/005* (2013.01); *G08B 25/10* (2013.01)

(58) Field of Classification Search
CPC ..... G08B 25/005; G08B 25/10; G08B 29/16
See application file for complete search history.

(56) References Cited

U.S. PATENT DOCUMENTS 5,103,474 A 4/1992 Stoodley et al.
9,786,106 B2 * 10/2017 Chua ..... G06K 7/10366
9,953,513 B2 * 4/2018 Chua ..... G08B 25/009
2002/0174367 A1 11/2002 Kimmel
(Continued)

FOREIGN PATENT DOCUMENTS

CN 202189447 U 4/2012
CN 203111119 U 8/2013
(Continued)

OTHER PUBLICATIONS

International Search Report dated Aug. 22, 2018 for International Application No. PCT/SG2018/050263 (in English).
(Continued)

*Primary Examiner* — John A Tweel, Jr.
(74) *Attorney, Agent, or Firm* — Martin & Ferraro, LLP

(57) ABSTRACT

A mobile monitoring unit adapted to monitor at least one premise is provided. Mobile monitoring unit is adapted to receive alarm signals from the at least one premise and respond to the alarm signals. Mobile monitoring unit includes a communication module configured to transmit a takeover instruction to another communication module of another mobile monitoring unit, such that upon receiving the takeover instruction, the another mobile monitoring unit is configured to receive the alarm signals and respond to the alarm signals. Further, a monitoring method for monitoring at least one premise is provided. Further, a mobile monitoring system adapted to monitor a plurality of premises is provided.

20 Claims, 6 Drawing Sheets

(56) References Cited

U.S. PATENT DOCUMENTS

| | | | | |
|---|---|---|---|---|
| 2003/0184436 | A1 | 10/2003 | Seales | |
| 2004/0085205 | A1 | 5/2004 | Yeh | |
| 2005/0174229 | A1 | 8/2005 | Feldkamp | |
| 2006/0242679 | A1 | 10/2006 | Hutchison, III et al. | |
| 2007/0139183 | A1 | 6/2007 | Kates | |
| 2009/0023421 | A1 | 1/2009 | Parkulo | |
| 2009/0041206 | A1 | 2/2009 | Hobby | |
| 2009/0042533 | A1 | 2/2009 | Lontka | |
| 2009/0322874 | A1* | 12/2009 | Knutson | G08B 25/009 348/143 |
| 2010/0013921 | A1 | 1/2010 | Joko | |
| 2011/0071880 | A1 | 3/2011 | Spector | |
| 2012/0078497 | A1 | 3/2012 | Burke, Jr. | |
| 2013/0006468 | A1 | 1/2013 | Koehrsen | |
| 2013/0009771 | A1 | 1/2013 | Simon | |
| 2014/0227967 | A1 | 8/2014 | Savage | |
| 2015/0015381 | A1 | 1/2015 | McNutt | |
| 2015/0113113 | A1 | 4/2015 | Yang | |
| 2015/0334087 | A1 | 11/2015 | Dawes | |
| 2016/0240076 | A1* | 8/2016 | Chua | G08B 25/14 |
| 2020/0320856 | A1* | 10/2020 | Zhang | G08B 21/18 |

FOREIGN PATENT DOCUMENTS

| | | | |
|---|---|---|---|
| JP | 2003-242231 | | 8/2003 |
| JP | 2004-185581 | | 7/2004 |
| JP | 2013-047946 | A | 3/2013 |
| TW | 200305115 | A | 10/2003 |
| TW | 200820754 | A | 5/2008 |

OTHER PUBLICATIONS

Written Opinion of the ISA dated Aug. 22, 2018 for International Application No. PCT/SG2018/050263 (in English).

International Preliminary Report on Patentability including Annexes dated Apr. 6, 2020 for International Application No. PCT/SG2018/050263 (in English).

EPO Supplementary Search Report and Search Opinion dated May 26, 2021 for EP Application No. 18920961.2.

* cited by examiner

MOBILE MONITORING SYSTEM, MOBILE MONITORING UNIT, AND MOBILE MONITORING METHOD

This is a National Phase Application under 35 USC 371 of International Application No. PCT/SG2018/050263 filed May 29, 2018; all of which is incorporated by reference herein in its entirety.

TECHNICAL FIELD

The present invention relates to a mobile monitoring system, a mobile monitoring unit and a mobile monitoring method. For example, the system can be a security mobile monitoring system, and/or a facility mobile monitoring system.

BACKGROUND

Surveillance of premises, e.g. buildings, complex, estates, have traditionally been handled by personnel who are stationed at such premises to carry out surveillance activities, e.g. patrolling. Personnel would survey the security and/or the facilities of the premise. Such activities are labour intensive and costly with increasing labour costs. With improvement of technology, the use of monitoring systems, e.g. cameras, sensors and alarms, have improved the efficiency and effectiveness of surveillance of such premises. Typically, the premise has a guard post or a command centre located within the premise to carry the monitoring activities. In an area where there are a number of premises, e.g. an estate of buildings, the number of personnel required to man the guard post or command centre can be substantial. The cost to maintain the number of personnel can also be very high. There have been examples where the monitoring of a plurality of premises is consolidated into a single guard post or command centre. However, the guard post or command centre is a single point of failure. In the event that the guard post or command centre is compromised, i.e. taken over or shut down by intruders, surveillance of the premises will no longer be possible. In such a situation, the premises will be left unguarded and property will be lost or damaged. Further, when there is an incident, e.g. security breach, power failure, at a premise, the number of personnel available to attend to the incident immediately is limited to the number of personnel on duty at the premise. Additional help provided by the city, e.g. police, fire brigade, may only arrive after a period of time. Therefore, the effectiveness and cost-efficiency of the current surveillance system is very low. While it is possible to have a multiple number of guard posts and command centres for one or a plurality of premises, the costs for running such a configuration will be very high.

It is therefore critical to provide a solution to the issues mentioned above. With the rising risks of terror attacks, it is more important to provide such a solution.

SUMMARY

According to various embodiments, a mobile monitoring unit adapted to monitor at least one premise is provided. Mobile monitoring unit is adapted to receive alarm signals from the at least one premise and respond to the alarm signals. Mobile monitoring unit includes a communication module configured to transmit a takeover instruction to another communication module of another mobile monitoring unit, such that upon receiving the takeover instruction, the another mobile monitoring unit is configured to receive the alarm signals and respond to the alarm signals.

According to various embodiments, the communication module may be configured to receive a verification request from the another mobile monitoring unit to verify the transmission of the takeover instruction, such that the mobile monitoring unit may further include a verification module configured to verify the verification request from the another mobile monitoring unit.

According to various embodiments, the verification request may include a video access request to access a camera within the mobile monitoring unit to view within the mobile monitoring unit.

According to various embodiments, the communication module may be configured to transmit a signal list comprising one or more of the alarm signals received by the mobile monitoring unit to the another mobile monitoring unit.

According to various embodiments, the unit may further include an activation trigger configured to activate the transmission of the takeover instruction.

According to various embodiments, the unit may further include an activation module configured to process a set of conditions and activate the transmission of the takeover instruction if the set of conditions satisfy a pre-determined set of conditions.

According to various embodiments, the communication module of the another mobile monitoring unit may be configured to receive a set of operational instructions for operating the mobile monitoring unit from the another mobile monitoring unit.

According to various embodiments, the set of operational instructions may include a shutdown instruction to immobilise or shut down the mobile monitoring unit.

According to various embodiments, the unit may further include a shutdown module configured to immobilise or shut down the mobile monitoring unit after the takeover instruction has been transmitted.

According to various embodiments, the unit may further include a token module configured to receive a token from a mobile monitoring unit and transmit the token to another mobile monitoring unit, the token being configured to store the takeover instruction, such that the communication module may be configured to automatically transmit the token to the another mobile monitoring unit within a pre-determined period of time, such that the token may be configured to transfer the takeover instruction to the another mobile monitoring unit.

According to various embodiments, a monitoring method for monitoring at least one premise is provided. The method includes monitoring at least one premise; and transmitting a takeover instruction from a mobile monitoring unit to another mobile monitoring unit, such that the mobile monitoring unit may be adapted to receive alarm signals from the at least one premise and responding to the alarm signals, such that, upon receiving the takeover instruction, the another mobile monitoring unit may be configured to receive the alarm signals and respond to the alarm signals.

According to various embodiments, the method may further include receiving a verification request from the another mobile monitoring unit to verify the transmission of the key from the mobile monitoring unit.

According to various embodiments, the verification request may include a video access request to access a camera within the mobile monitoring unit to view within the mobile monitoring unit.

According to various embodiments, the method may further include transmitting a signal list comprising one or more of the alarm signals received by the mobile monitoring unit to the another mobile monitoring unit.

According to various embodiments, the method may further include receiving an activation signal and activating the transmission of the takeover instruction.

According to various embodiments, the method may further include processing a set of pre-determined conditions and activating, based on the set of predetermined conditions, the transmission of the takeover instruction.

According to various embodiments, the method may further include receiving a set of operational instructions for operating the mobile monitoring unit from the another mobile monitoring unit.

According to various embodiments, the set of operational instructions may include an instruction to immobilise or shut down the mobile monitoring unit.

According to various embodiments, the method may further include immobilising or shutting down the mobile monitoring unit after transmitting the takeover instruction.

According to various embodiments, the method may further include automatically transmitting a token from the mobile monitoring unit to the another mobile monitoring unit within a pre-determined period of time, such that the token may be configured to store the takeover instruction and download the takeover instruction to the another mobile monitoring unit.

According to various embodiments, a mobile monitoring system adapted to monitor a plurality of premises is provided. The system includes a plurality of mobile monitoring units described above adapted to monitor the plurality of premises, each of the plurality of mobile monitoring units may be adapted to receive alarm signals from the plurality of premises and respond to the alarm signals, such that a first mobile monitoring unit of the plurality of mobile monitoring units may be adapted to transmit a takeover instruction to a second mobile monitoring unit of the plurality of mobile monitoring units, such that upon receiving the takeover instruction, the second mobile monitoring unit may be configured to receive the alarm signals and respond to the alarm signals.

According to various embodiments, the second mobile monitoring unit may be configured to transmit a verification request to the first mobile monitoring unit to verify the transmission of the takeover instruction from the first mobile monitoring unit.

According to various embodiments, the verification request may include a video access request to access a camera within the first mobile monitoring unit to view within the first mobile monitoring unit.

According to various embodiments, the first mobile monitoring unit may be configured to transmit a signal list comprising one or more of the alarm signals received by the first mobile monitoring unit to the second mobile monitoring unit.

According to various embodiments, the first mobile monitoring unit may be configured to receive a set of operational instructions for operating the mobile monitoring unit from the second mobile monitoring unit.

According to various embodiments, the set of operational instructions may include an instruction to immobilise or shut down the first mobile monitoring unit.

According to various embodiments, the first mobile monitoring unit may be configured to be immobilised or shut down after the takeover instruction has been transmitted.

According to various embodiments, the plurality of mobile control units are configured to automatically transmit a token from one of the plurality of mobile monitoring units to another within a pre-determined period of time, such that the token may be configured to store the takeover instruction from the first mobile monitoring unit and transfer the takeover instruction to the second mobile monitoring unit.

DETAILED DESCRIPTION

Figure 1:
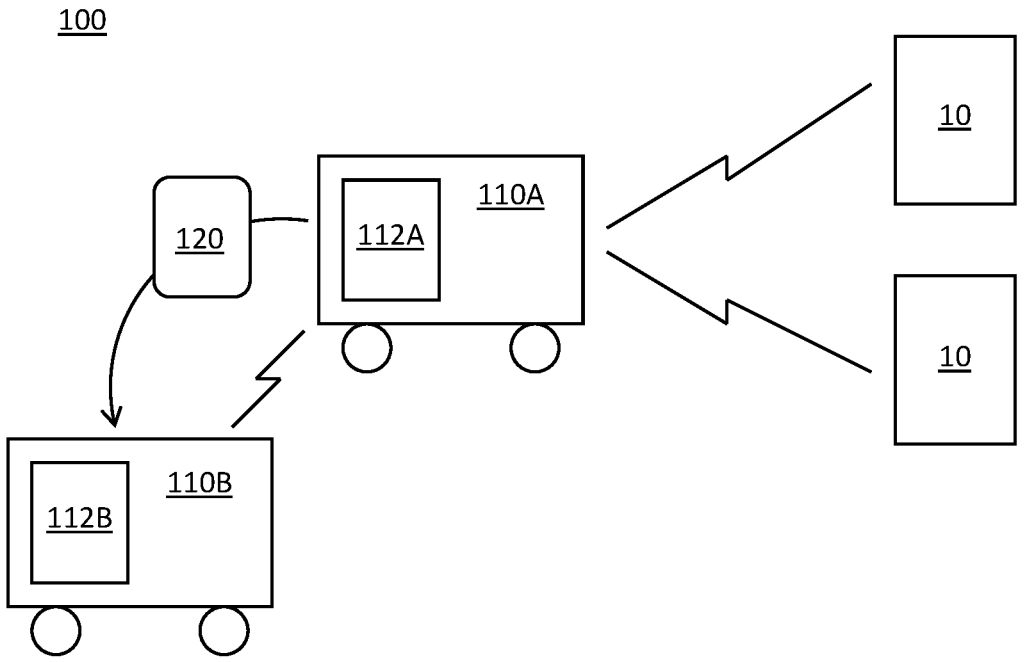
FIG. 1 shows a schematic diagram of an example of a mobile monitoring system adapted to monitor a plurality of premises.

FIG. 1 shows a schematic diagram of an example of a mobile monitoring system 100 adapted to monitor a plurality of premises 10. Mobile monitoring system 100 includes a plurality of mobile monitoring units 110 adapted to monitor the plurality of premises 10. Each of the plurality of mobile monitoring units 110 is adapted to receive alarm signals from the plurality of premises 10 and respond to the alarm signals. Each mobile monitoring unit 110 may be configured to monitor premise systems used in a premise 10, e.g. a building, apartment within a building, remotely. Premise systems may include security systems, building services systems, etc. Each mobile monitoring units 110 may be configured to monitor the security systems of the premises 10, e.g. card access system, close circuit TV system, intruder alarm system, etc. Each mobile monitoring system 100 may be configured to monitor the building services systems of the premises 10, e.g. fire alarm system, lift system, air-conditioning system, etc. Premise systems may be configured to transmit an alarm signal when the systems detect an abnormality, e.g. intruder, fire, lift breakdown. Each mobile monitoring unit 110 may respond to the alarm signals by remotely controlling the premise systems, e.g. view a location of the premise 10 via the close-circuit TV, activate fire extinguishing systems remotely, open a gantry for a visitor remotely. Mobile monitoring system 100 may respond to the alarm signals by moving to the premises 10 to attend to the cause of the alarm signals, e.g. turn off water source of a burst pipe, search a premise, etc. As shown, the mobile monitoring system 100 provides a mesh network of security and facility solution.

As shown in FIG. 1, the mobile monitoring unit 110 is adapted to monitor at least one premise 10, the mobile monitoring unit 110 is adapted to receive alarm signals from the at least one premise 10 and respond to the alarm signals. Each of the plurality of mobile monitoring units 110 may include a communication module 112 adapted to communicate with another. Communication module 112 may be configured to transmit and receive data. A plurality of mobile monitoring units 110 may communicate with each other without a control centre or command centre. A plurality of mobile monitoring units 110 may communicate with each other wirelessly, e.g. via local area network, mobile phone network, Super Wi-Fi network, etc. Plurality of mobile monitoring units 110 may be configured to transmit information between each other. For example, the plurality of mobile monitoring units 110 may transmit operational status of each mobile monitoring unit 110, e.g. active, non-active, faulty, monitoring history of the premises 10, operating instructions, etc. As the plurality of mobile monitoring units 110 are configured to communicate with each other, each of the mobile monitoring units 110 may be able to know the status of other mobile monitoring units 110. Without a control centre, the mobile monitoring units 110 are not controlled from one point of contact. In this way, the mobile monitoring system 100 prevents a single point of failure. In an example where the mobile control units 110 are controlled by the control centre, the monitoring operation will be disrupted if the control centre is compromised or shut down. Similarly, in a scenario where a guard post or command centre monitors a plurality of premises, the guard post or command centre is potentially a single point of failure where the monitoring operation of the premises will be disrupted if the guard post or command centre is compromised or shut down. In other words, the mobile monitoring units 110 are able to provide multiple layers of safeguards to the monitoring operation as there is a backup mobile monitoring unit to take over the monitoring operation should one mobile monitoring unit is unable to carry out the operation. Mobile monitoring system 100 provides a useful platform against security threats and enhances the response efficiency during critical situations.

Mobile monitoring system 100 is able to provide a dynamic monitoring system to monitor a plurality of premises 10. Mobile monitoring system 100 may include a plurality of mobile monitoring units 110, e.g. two, three, four or five, to monitor a plurality of premises 10, e.g. five, fifteen, thirty, fifty buildings. For example, the mobile monitoring system 100 may include five mobile monitoring units 110 to monitor fifteen buildings. While each mobile monitoring unit 110 may be assigned a group of buildings, e.g. three buildings, to monitor, the number of mobile monitoring units 110 or the number of buildings under the purview of each mobile monitoring unit 110 may change depending on the situation of the premises 10. If necessary, the number of mobile monitoring units 110 for a group of buildings may be varied, e.g. increased or decreased. In other words, the number of buildings under the purview of each mobile monitoring unit 110 may vary, e.g. increase or decrease. Further, the mobile monitoring system 100 reduces the need to have a guard post or command centre at every premise, e.g. building. Consequently, the manpower required to monitor the same number of premises is reduced. In addition, when necessary, the number of mobile monitoring units 110 may increase for a group of premises 10 if necessary. In this way, the mobile monitoring system 110 provides an effective and cost-efficient system and method for monitoring a plurality of premises 10.

Mobile monitoring system 100 may include at least one mobile monitoring unit 110, i.e. a first mobile monitoring unit 110A and another mobile monitoring unit, i.e. a second mobile monitoring unit 110B. First mobile monitoring unit 110A that is monitoring a first group of buildings may communicate with the second mobile monitoring unit 110, which may be monitoring a second group of buildings. In the event of an emergency situation, e.g. there is a security breach in one of the buildings, the first mobile monitoring unit 110A may request the second monitoring unit for assistance. Preferably, the second mobile monitoring unit 110B is within close proximity to the first mobile monitoring unit 110A. If the second group of buildings are in normal condition, i.e. no incidents or alarm signal received from the second group of buildings, the second mobile monitoring unit 110B may partially or completely take over the monitoring of the first group of buildings so that the first mobile monitoring unit 110A may then respond to the situation, e.g. respond remotely, go to the building to investigate so as to attend to the cause of the alarm.

Second mobile monitoring unit 110B may either move to the location of the first mobile monitoring unit 110A or remain in its original location and monitor the group of buildings remotely. Second mobile monitoring unit 110B may be a backup and respond to the situation if necessary. As the second mobile monitoring unit 110B is in close proximity to the first mobile monitoring unit 110A, the second mobile monitoring unit 110B may be able to reach the location of the first mobile monitoring unit 110A, or the building with the emergency quickly. As shown, the mobile monitoring system 100 provides a dynamic monitoring system where the configuration of mobile monitoring units 110 may be rearranged to suit the situation of the plurality of premises 10.

Figure 2:
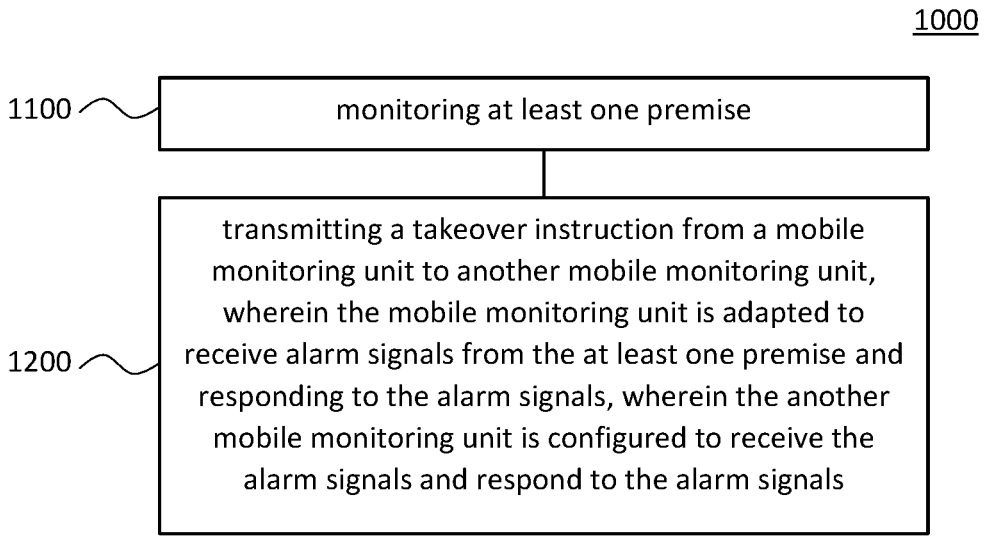
FIG. 2 shows a flow diagram of an exemplary monitoring method for monitoring at least one premise.

FIG. 2 shows a flow diagram of an exemplary monitoring method 1000 for monitoring at least one premise 10. Method 1000 includes monitoring at least one premise 10 in block 1100, transmitting a takeover instruction 120 from a mobile monitoring unit 110 to another mobile monitoring unit 110, such that the mobile monitoring unit 110 is adapted to receive alarm signals from the at least one premise 10 and responding to the alarm signals in block 1200, and upon receiving the takeover instruction 120, the another mobile monitoring unit 110 is configured to receive the alarm signals and respond to the alarm signals.

Figure 3:
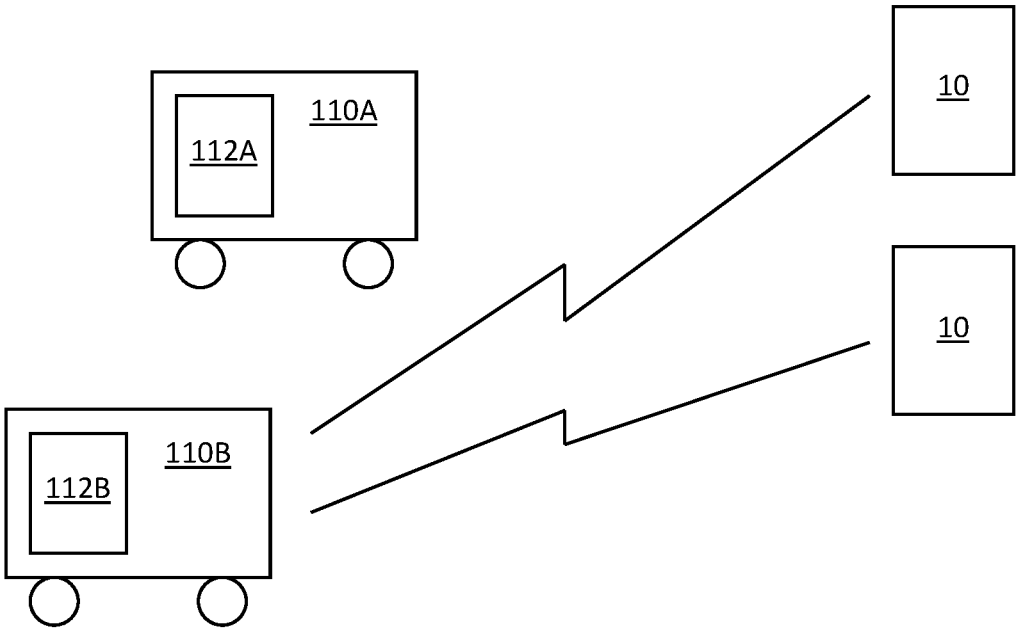
FIG. 3 shows a schematic diagram of an example of the mobile monitoring system after the takeover instruction is transferred from the first mobile monitoring unit to the second mobile monitoring unit.

FIG. 3 shows a schematic diagram of an example of the mobile monitoring system 100 after the takeover instruction 120 is transferred from the first mobile monitoring unit 110A to the second mobile monitoring unit 110B. When the first mobile monitoring unit 110A requests the second mobile monitoring unit 110B for assistance, it may transmit a takeover instruction 120 to the second mobile monitoring unit 110B of the plurality of mobile monitoring units 110. Communication module 112A of the first mobile monitoring unit 110A is configured to transmit the takeover instruction 120 to the communication module 112B of the second mobile monitoring unit 110B. Upon receiving the takeover instruction 120 from the first mobile monitoring unit 110A, the second mobile monitoring unit 110B is configured to receive the alarm signals and respond to the alarm signals from the plurality of premises 10.

Figure 4:
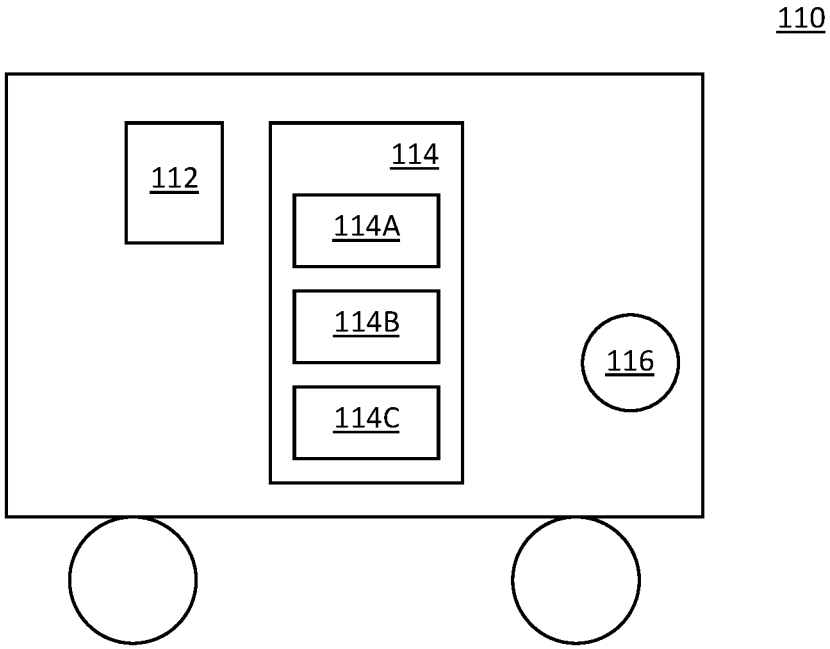
FIG. 4 shows a schematic diagram of an example of the mobile monitoring unit.

FIG. 4 shows a schematic diagram of an example of the mobile monitoring unit 110. Mobile monitoring unit 110 may include a computing device 114, e.g. a server, comprising a processor 114A, a system memory 114B, a data storage 114C, a display, a network controller, etc. Computing device 114 may include a mobile device, e.g. laptop, mobile phone, a tablet, etc. Communication module 112 may be in communication with the computing device 114 via the network controller. Communication module 112 may be incorporated into the computing device 114. While it is shown that the computing device 114 may be mounted in a vehicle in FIG. 4, the computing device 114 may be portable and carried by a person. Mobile monitoring unit 110 may include at least one of land vehicle, air vehicle and sea vehicle. Vehicle may be a car, a van, an aircraft, personal mobility device, a water vessel, etc.

Takeover instruction 120 may include an access module configured to access the computing device 114 of the first mobile monitoring unit 110A when activated. Access module may be configured to access the computing device 114 of the first mobile monitoring unit 110A. Access module may be configured to communicate with a camera of the first mobile monitoring unit, whereby the camera is in communication with the computing device 114. Access module may include a program configured to access the computing device 114 and/or the camera. Access module may display a link, e.g. a hyperlink, a button, to be activated to access the computing device 114. Upon receiving the takeover instruction 120, the access module may display on a display of the second mobile monitoring unit 110B. Personnel in the second mobile monitoring unit 110B may activate the access module, e.g. by clicking on the hyperlink or button, to activate the program. In an example, the second mobile monitoring unit 110B may view the interior of the first mobile monitoring unit 110A via a camera within therein to determine if the first mobile monitoring unit 110A is in working condition. Access module may be activated to transmit a message or an email to the first mobile monitoring unit 110A. Access module may be configured to dial into the telecommunication system of the first mobile monitoring unit 110A to allow the second mobile monitoring unit 110B to communicate with the first mobile monitoring unit 110A. In this way, the second mobile monitoring unit 110B may verify that the takeover instruction 120 is genuine.

Figure 5:
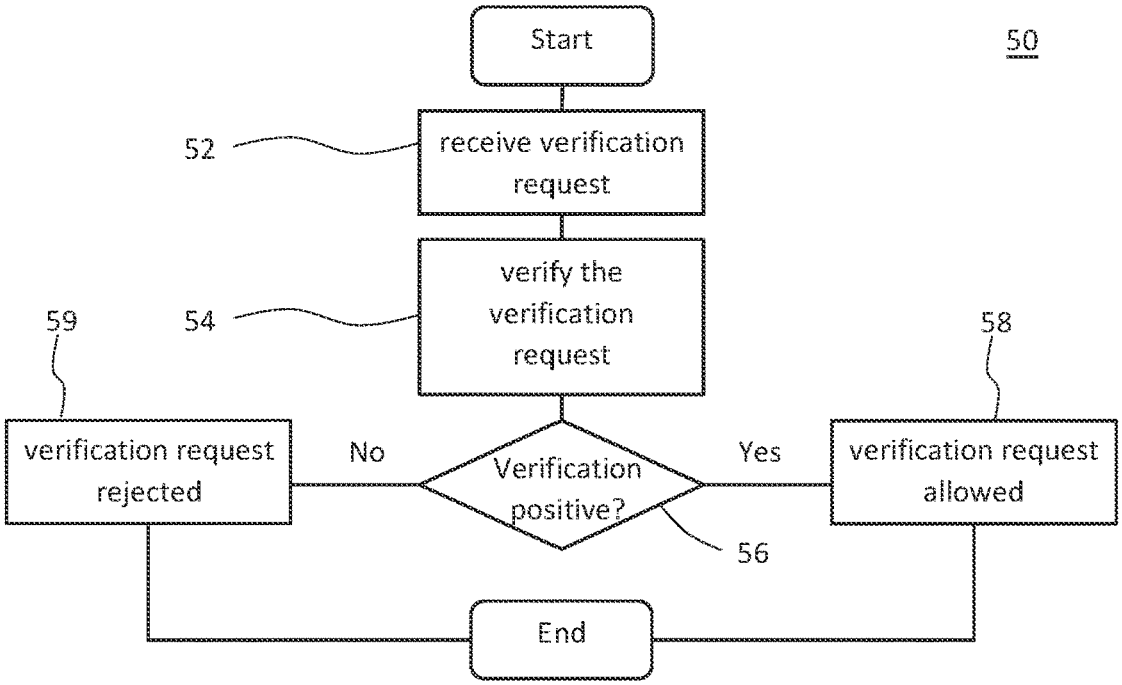
FIG. 5 shows a flow diagram of the verification of the transmission of the takeover instruction.

FIG. 5 shows a flow diagram 50 of the verification of the transmission of the takeover instruction 120. Communication module 112 of the first mobile monitoring unit 110A may be configured to receive a verification request from the second mobile monitoring unit 110B to verify the transmission of the takeover instruction 120 at 52, such that the first mobile monitoring unit 110A includes a verification module configured to verify the verification request from the another mobile monitoring unit 110 at 54. Verification module may be in communication with the communication module 112. Verification module may reside in the system memory 114B. When the second mobile monitoring unit 110B receives the takeover instruction 120, the second mobile monitoring unit 110B may verify that the takeover instruction 120 is transmitted by the first mobile monitoring unit 110A. Second mobile monitoring unit 110B may transmit a verification request to the first mobile monitoring unit 110A. First mobile monitoring unit 110A may receive the verification request. Upon receipt of the verification request, the first mobile monitoring unit 110A may verify that the verification request is from the second mobile monitoring unit 110B at 56. It is important to verify that the takeover instruction 120 to ensure that the takeover instruction 120 is not transmitted accidentally or by an unauthorised source. Verification request may include a video access request to access a camera within the first mobile monitoring unit 110A to view within the first mobile monitoring unit 110A. Verification request may include a message, email, phone call, etc. Second mobile monitoring unit 110B may attempt to view within the first mobile monitoring unit 110A to investigate the situation within the first mobile monitoring unit 110A. For example, the second mobile monitoring unit 110B may investigate the reason for the transmission of the takeover instruction 120. By allowing the request to view within the first mobile monitoring unit 110A, the first mobile monitoring unit 110A may compromise the security of the unit by allowing unauthorised viewing of the unit by a hostile party. Therefore, it is important for the first mobile monitoring unit 110A to verify that the verification request is from the second mobile monitoring unit 110B. Verification module may be configured to authenticate the source of the verification request to ensure that the source of the verification request tallies with the target unit, i.e. the second mobile monitoring unit 110B, to which the takeover instruction 120 was transmitted to. In this way, the verification module may be configured to automatically verify the verification request without human intervention so that in the event that the personnel within the first mobile monitoring unit 110A is incapacitated, the second mobile monitoring unit 110B may still be able to view within the first mobile monitoring unit 110A to investigate the reason for the transmission of the takeover instruction 120. If the verification of the verification request is positive, the verification request will be allowed at 58, i.e. the second mobile monitoring unit 110B may be able to view the inside of the first mobile monitoring unit 110A. Accordingly, if the verification of the verification request is negative, the verification request will be rejected at 59. In this way, it is possible to prevent unauthorised viewing of the inside of the first mobile monitoring unit 110A.

Communication module 112 of the first mobile monitoring unit 110A may be configured to transmit a signal list having one or more of the alarm signals received by the first mobile monitoring unit 110A to the second mobile monitoring unit 110B. When the first mobile monitoring unit 110A receives alarm signals from at least one premise 10, it may maintain the signal list by recording details of each of the alarm signals, e.g. date, time, source, nature of alarm signal. When the takeover instruction 120 is transmitted, the takeover instruction 120 may include the signal list. In this way, the second mobile monitoring unit 110B may be able to retrieve the details of the alarm signals from the signal list and, if necessary, take the necessary action to respond and address the cause of the alarm signal. As mentioned, the second mobile monitoring unit 110B may take over the monitoring completely or partially from the first mobile monitoring unit 110A. A partially monitoring may include taking over the monitoring of some of the alarm signals from the plurality of premises 10. For example, monitoring a portion of the number of premises 10, some of the systems within a premise 10. A complete monitoring may include taking over the monitoring of all the alarm signals from the plurality of premises 10 that the first mobile monitoring unit 110A was monitoring. In certain situations when the first mobile monitoring unit 110A is no longer able to monitor the premises 10, e.g. when it needs to attend to emergencies at a premise 10, when the unit breaks down, when the unit is taken over by unauthorised personnel, the second mobile monitoring unit 110B would be able to take over the monitoring of the premises 10 that the first mobile monitoring unit 110A was monitoring.

Transmission of the takeover instruction 120 may be activated manually or automatically. Mobile monitoring unit may include an activation trigger 116 configured to activate the transmission of the takeover instruction 120. Transmission of the takeover instruction 120 may be activated by manually activating the activation trigger 116. Activation trigger 116 may include a physical button or switch located within the mobile monitoring unit, e.g. at the driver's panel. Activation trigger 116 may be a graphical user interface displayed on the display of the computing device 114 in the mobile monitoring unit 110. Activation trigger 116 may be triggered by a personnel of the mobile monitoring unit 110 when necessary, e.g. when unit breaks down, when attacked by intruders. Transmission of the takeover instruction 120 may be automated. Mobile monitoring unit 110 may include an activation module configured to process a set of conditions and activate the transmission of the takeover instruction 120 if the set of conditions satisfy a pre-determined set of conditions. Activation module may be stored in the system memory 114B of the computing device 114. Mobile monitoring unit 110 may include sensors for detecting the conditions of the mobile monitoring unit 110. Sensors may detect in and outside of the mobile monitoring unit 110. Sensors may be in communication with the computing device 114. Sensors may include, motion sensors, heat sensors, shock sensors, etc. Computing device 114 may receive a set of conditions from the sensors. A set of pre-determined conditions may be configured by the personnel controlling the mobile monitoring unit 110. The set of pre-determine conditions may include breakdown of vehicle, collision of vehicle, etc. As shown, when the set of conditions is fulfilled, the takeover instruction 120 may be automatically transmitted. As there may be a possibility that the set of pre-determined conditions may be satisfied unintentionally, e.g. due to sensor malfunction, and causing the activation trigger 116 to be activated to transmit the takeover instruction 120, it is preferable, if not necessary, to have the verification by the second mobile monitoring unit 110B so as to avoid unintentional taking over of the mobile monitoring unit 110.

First mobile monitoring unit 110A may be configured to store a set of operational instructions for operating the first mobile monitoring unit 110A. The set of operational instructions may be stored in the system memory 114B of the computing device 114. The set of operational instructions may be a set of standard operating procedures or protocols for taking over the first mobile monitoring unit 110A, a set of instruction to monitor the plurality of premises 10, etc. Takeover instruction 120 may include the set of operational instructions. Upon activation of the activation trigger 116, the set of operational instructions may be transmitted to the second mobile monitoring unit 110B. Communication module 112 of the second mobile monitoring unit 110B may be configured to receive the set of operational instructions for operating the first mobile monitoring unit 110A from the first mobile monitoring unit 110A. A set of operational instructions may be APIs to communicate between the communication modules 112A,112B of the first mobile monitoring unit 110A and the second mobile monitoring unit 110B. Set of operational instructions may include a shutdown instruction to immobilise or shut down the mobile monitoring unit 110, e.g. the first mobile monitoring unit 110A. Shutdown instruction may be transmitted to the second mobile monitoring unit 110B so that the second mobile monitoring unit 110B may, upon receipt of the shutdown instruction, activate it to shut down the first mobile monitoring unit 110A. Shutdown instruction may be encrypted and may only be decrypted by the computing device 114 of the first mobile monitoring unit 110A. It is not possible for anyone to shut down the mobile monitoring unit 110 unless the person is in possession of the shutdown instruction and activates it. By transmitting the shutdown instruction to the second mobile monitoring unit 110B, the second mobile monitoring unit 110B will be able to shut down the first mobile monitoring unit 110A if the second mobile monitoring unit 110B determines that the situation requires the first mobile monitoring unit 110A to be shut down, e.g. when first mobile monitoring unit 110A is taken over by unauthorised personnel. First mobile monitoring unit 110A may be configured to be shutdown automatically once the takeover instruction 120 has been transmitted. First mobile monitoring unit 110A may include a shutdown module configured to immobilise or shut down the first mobile monitoring unit 110A after the takeover instruction 120 has been transmitted. Shutdown module may include the shutdown instruction for shutting down the first mobile monitoring unit 110A. As the personnel in the first mobile monitoring unit 110A may recognise that in the event that the takeover instruction 120, e.g. a complete takeover instruction 120, is to be transmitted, it may be due to drastic condition and necessary to shut down the first mobile monitoring unit 110A. Therefore, the shutdown module may be configured to shut down the first mobile monitoring unit 110A after the takeover instruction 120 is transmitted. As shown, any mobile monitoring unit 110 may be configured to be shut down and monitoring of the premises may be migrated from the mobile monitoring unit 110 to another. This configuration allows multiple backups to be possible and enables an efficient and cost-effective security and facility monitoring system and method.

Each of the mobile monitoring unit 110 may maintain an activity log to record the activities carried out by the mobile monitoring unit 110. Based on the above example, when transmitting the takeover instruction 120, the activity log may be transmitted at the same time so that the second mobile monitoring unit 110B may know the activities carried out by the first mobile monitoring unit 110A. Computing device 114 may store a substantial amount of data from the activities carried out by the mobile monitoring unit 110. For example, the computing device 114 may store the video and audio files, the activity log, etc. Large-sized files may be backed-up to the data storage at base stations when the mobile monitoring unit 110 returns to the base. Activity log may include links to the video and audio files so that the second mobile monitoring unit 110A may access the files if need be after receiving the takeover instruction. In this way, the file size of the data to be transmitted can be minimised for fast transmission.

Each of the mobile monitoring units 110 may include a key for operating the mobile monitoring unit 110. The key may be configured to authorise the operation of the mobile monitoring unit 110. Mobile monitoring unit 110 may be configured such that, without the key, the mobile monitoring unit 110 and the systems therein may not be operable. Key may be a digital key, e.g. a code, an alphanumeric string. Takeover instruction 120 may include the key. Mobile monitoring unit 110 may be shut down by removing the key. A digital key may be removed by deleting or changing the code for the key. When the activation trigger is activated, the key may be attached to the takeover instruction to be transmitted. Key may be removed or deleted by a pre-determined time period after the transmission of the takeover instruction.

Each of the mobile monitoring unit 110 may have an identifier for identifying the mobile monitoring unit 110. Takeover instruction 120 may include the identifier so that the second mobile monitoring unit 110B may identify the source of the takeover instruction 120 when it receives the takeover instruction 120. When the second mobile monitoring unit 110B transmits the verification request, the identifier of the second mobile monitoring unit 110B may be attached to the verification request so that the first mobile monitoring unit 110A may verify the identity of the source of verification request.

Figure 6:
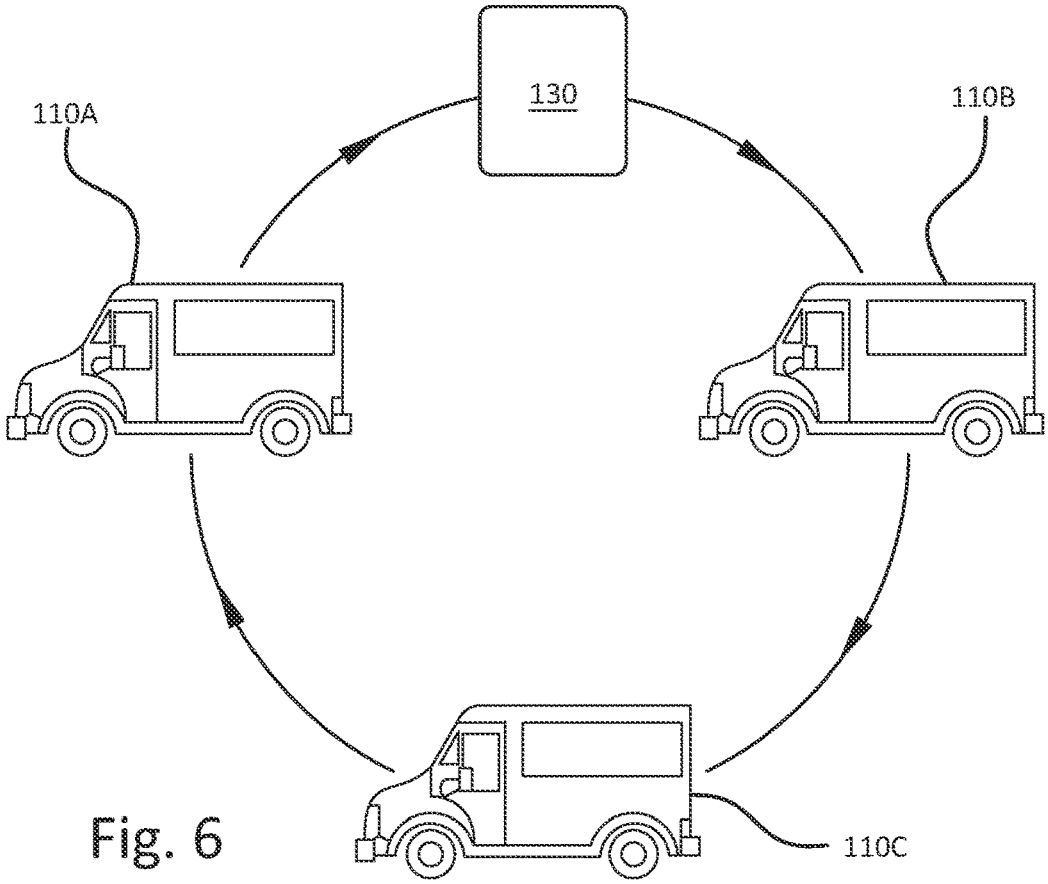
FIG. 6 shows a schematic diagram of the mobile monitoring system with a token.

FIG. 6 shows a schematic diagram of the mobile monitoring system 100 with a token 130. Referring to FIG. 6, the mobile monitoring system 100 may include a plurality of mobile monitoring units 110, e.g. three mobile monitoring units 110. As shown above, the mobile monitoring system 100 may be configured to transmit the takeover instruction 120 either manually or automatically from one mobile monitoring unit 110 to another. FIG. 6 shows an example of another method of transmitting the takeover instruction 120. Each of the mobile monitoring units 110 may include a token module configured to receive a token 130 from a mobile monitoring unit 110 and transmit the token 130 to another mobile monitoring unit 110. Communication module 112 may be configured to receive the token 130. Communication module 112 may be configured to automatically transmit the token 130 to the another mobile monitoring unit 110 within a pre-determined period of time, e.g. 10 seconds, 1 minute. In other words, the token 130 may be transferred from one mobile monitoring unit 110 to another. Token 130 may be transmitted from one mobile monitoring unit 110 to another automatically. In this way, the security of the transmission is improved. As the token 130 is continuously in "motion", and the duration of the token residing at a mobile monitoring unit 110 can be relatively short, e.g. few seconds, it is difficult for someone to locate the location of the token and have sufficient time to "hack" into the token 130. As such, the security of this method of transmitting the takeover instruction may be better than other methods. Communication module 112 may be configured to automatically transmit the token 130 based on a pre-determined set of conditions being met.

Token 130 may be transmitted upon activation of the activation trigger 116. Each mobile monitoring unit 110 may include a token 130 transfer sequence list which records the sequence of transmission between the plurality of mobile monitoring units 110. Referring to FIG. 6, the sequence list may include the sequence of mobile monitoring units 110A, 110B,110C such that the token 130 may be transmitted from mobile monitoring unit 110A to mobile monitoring unit 110B, then to mobile monitoring unit 110C and back to mobile monitoring unit 110A. The sequence list may be updated as and when there is an addition or removal of mobile monitoring units 110 from the mobile monitoring system 100. Token 130 may be circulated between the plurality of mobile monitoring units 110 in the order of the sequence list. Sequence list may be arranged in order of proximity, i.e. next nearest mobile monitoring unit 110. Sequence list may be synchronized among all the mobile monitoring units 110.

Figure 7:
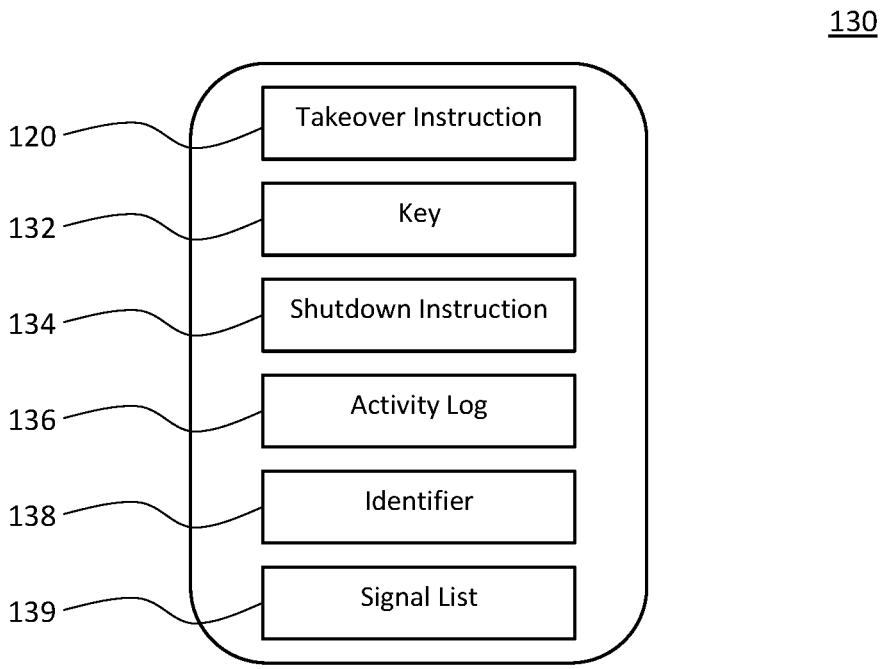
FIG. 7 shows a schematic diagram of an example of the token.

FIG. 7 shows a schematic diagram of an example of the token 130. Token 130 may be configured to store the takeover instruction 120. When the token 130 is transmitted to another mobile monitoring unit 110, the token 130 may be configured to transfer the takeover instruction 120 to the another mobile monitoring unit 110. Token 130 may be a digital token 130. Token 130 may store the key 132 of the mobile monitoring unit 110, e.g. the first mobile monitoring unit 110A. By transmitting the token 130, the key to the first mobile monitoring unit 110A may be removed thereby shutting down the mobile monitoring unit 110. Second mobile monitoring unit 110B may receive at least one of the key and the takeover instruction 120 via the token 130. Second mobile monitoring unit 110B may be able to operate the first mobile monitoring unit 110A with the key and the takeover instruction 120. Token 130 may be configured to store the shutdown instruction 134, the activity log 136, the identifier 138, the signal list 139 etc. and when received, the second mobile monitoring unit 110B may be able to identify, shut down, review the activities and signal list of the first mobile monitoring unit 110A, etc.

Figure 8A:
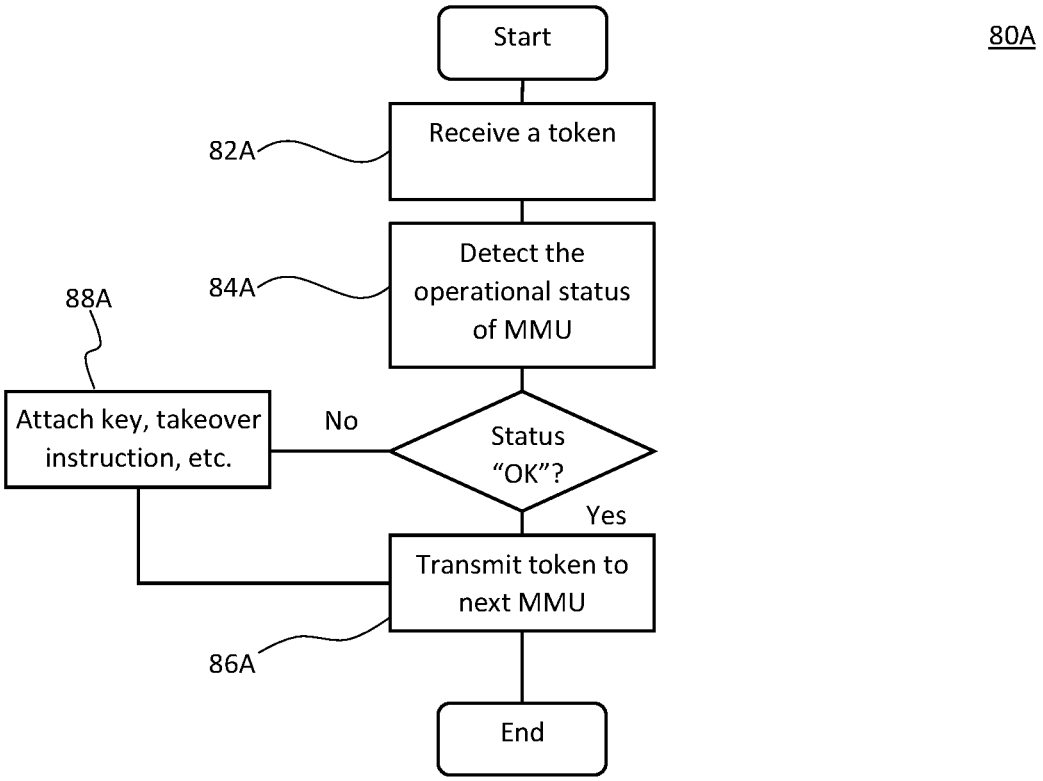
FIG. 8A shows a flow diagram of an example of the token module being received and transmitted by a mobile monitoring unit.

FIG. 8A shows a flow diagram 80A of an example of the token module being received and transmitted by a mobile monitoring unit 110. Each mobile monitoring unit 110 may include an operational status to indicate the status of the mobile monitoring unit 110. Operational status may include a binary status, e.g. "1" and "0", "on" and "off", "OK" and "Not OK", etc. Token module may be configured to receive the operational status. The transmission of a token 130 may be initiated by a mobile monitoring unit 110, e.g. a first mobile monitoring unit 110A. As shown in FIG. 8A, when a token 130 is being transmitted to the next mobile monitoring unit 110, e.g. a second mobile monitoring unit 110B, the token module of the second mobile monitoring unit 110B receives the token 130 at block 82A may be configured to detect the operational status thereof at block 84A. If the status of the second mobile monitoring unit 110B is "OK", the token module may transmit the token 130 to the next mobile monitoring unit at block 86A, i.e. a third mobile monitoring unit 110C. Token 130 may be circulated in the order of the sequence list and back to the first mobile monitoring unit 110A. If the operational status is "Not OK", the token module may be configured to attach at least one of the key 132, the takeover instruction 120, the signal list, identifier, the activity log, etc to the token 130 at block 88A. When the key is being attached to the token 130, the computing device 114 may "remove" the key 132 from the second mobile monitoring unit 110B. Token module may be configured to transmit the token 130 to the next mobile monitoring unit 110, i.e. the third mobile monitoring unit 110C.

Figure 8B:
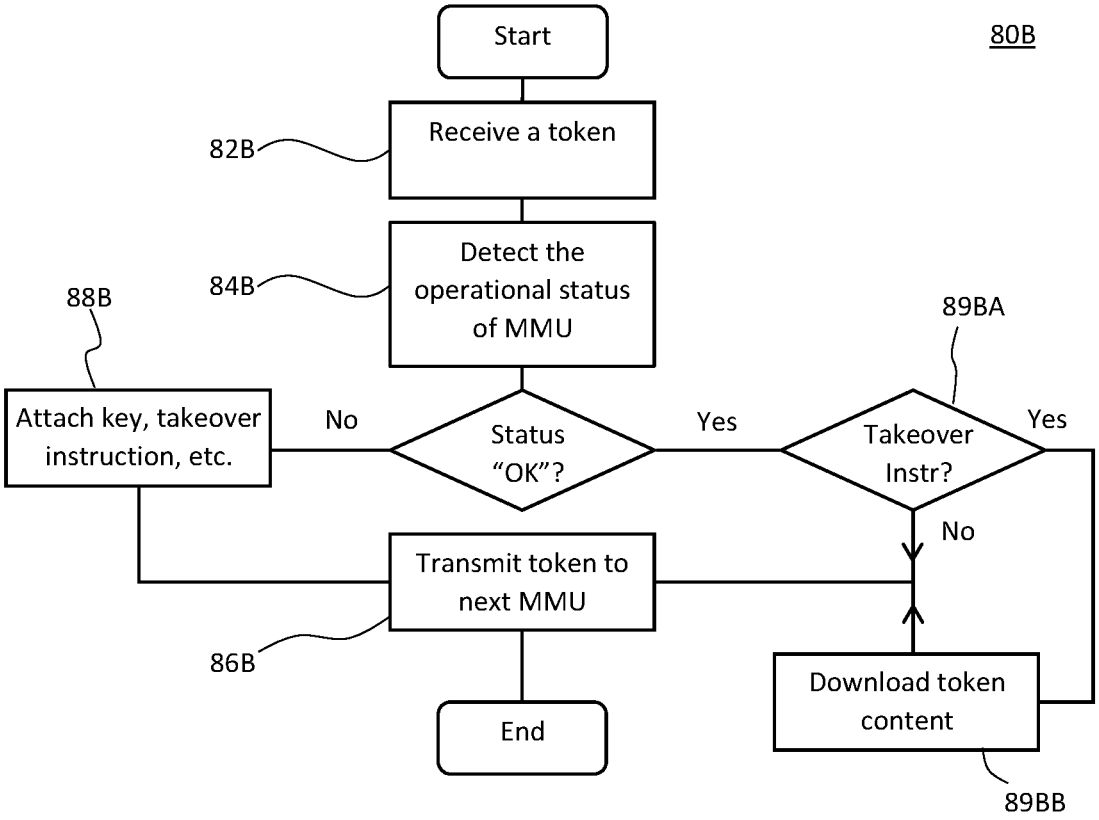
FIG. 8B shows a flow diagram of an example of the token module being received and transmitted by a mobile monitoring unit

FIG. 8B shows a flow diagram 80B of an example of the token module being received and transmitted by a mobile monitoring unit. Similar to FIG. 8A, the token module of the third mobile monitoring unit 110C may receive the token 130 at block 82B. Token module of the third mobile monitoring unit 116E may retrieve and verify the operational status of the third mobile monitoring unit 110C at block 84B. If the operational status of the third mobile monitoring unit 110C is "OK", the token module may check if there is a takeover instruction 120 attached at 89BA. If there is a takeover instruction 120 attached, the content of the token 130 may be downloaded at 89BB to the computing device of the third mobile monitoring unit 110C. In the event that the third mobile monitoring unit 110C is "Not OK", the token module may be configured to attach at least one of the key 132, the takeover instruction 120, the signal list, identifier, the activity log, etc to the token 130 of the third mobile monitoring unit 110C at block 88B. As such, the token 130 may include the takeover instruction 120 of two mobile monitoring units 110, e.g. the second mobile monitoring unit 110B and the third mobile monitoring unit 110C. Thereafter, the token 130 may be transmitted to the next mobile monitoring unit 110 at block 86B. Alternatively, the token module may transmit the token 130 to the next mobile monitoring unit 110 without attaching the above information if the token module is configured to attach only one takeover instruction 120 in the token 130. Upon receiving the token 130 content, the third mobile monitoring unit 110C may carry out one of the activities as described earlier, e.g. verify the takeover instruction 120, activate and operate the second mobile monitoring unit 110B with the key, monitor the alarm signals from the plurality of premises 10, shutdown the second mobile monitoring unit 110B, etc. Token 130 may include the activity log 136. While it is possible to include video/audio files, it is preferred to attach only links to the files so as not to slow down the transmission of the token 130. Token module may reside in the system memory 114E of the computing device 114.

Figure 9:
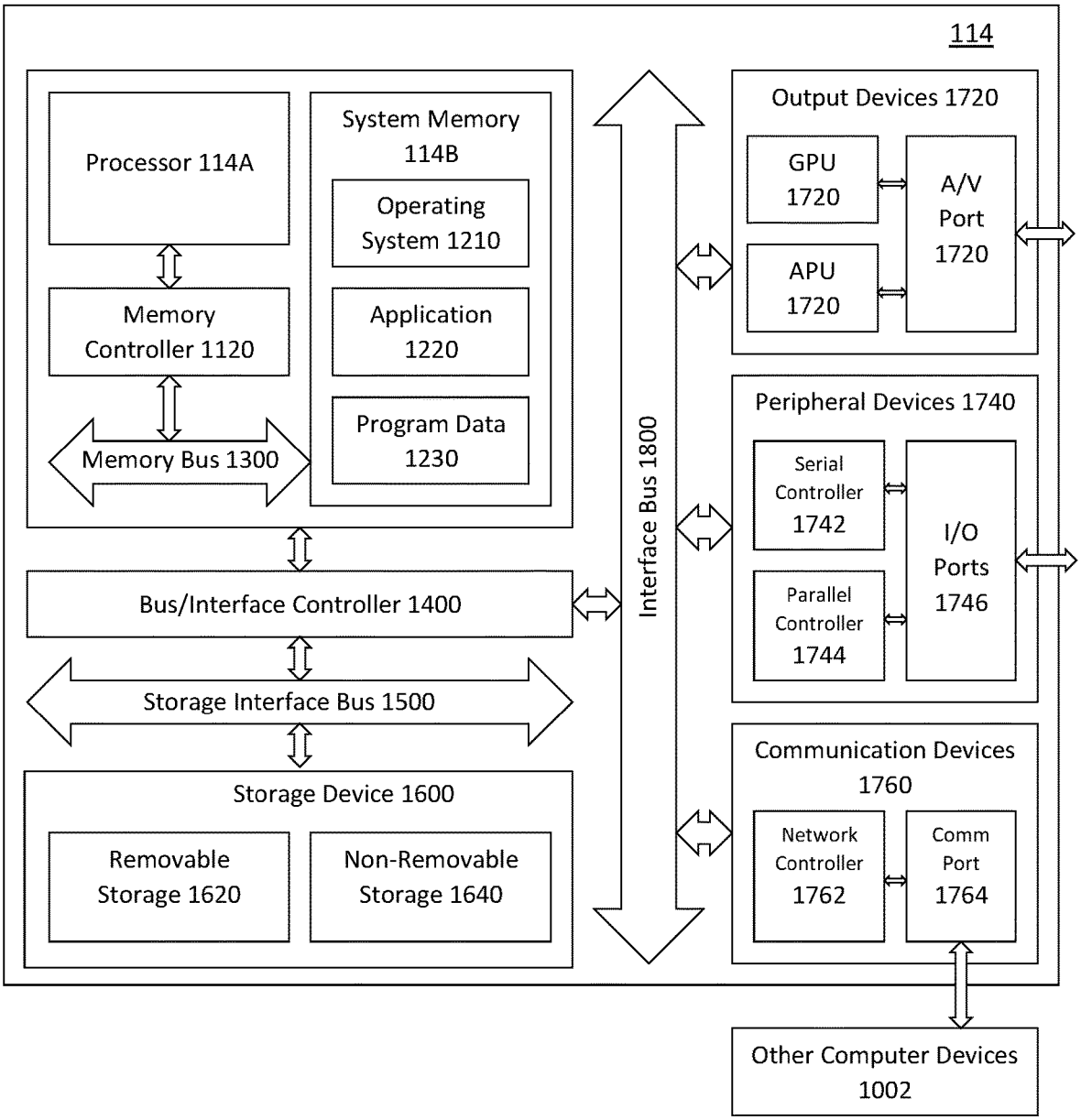
FIG. 9 shows an example of a block diagram of a computing device.

FIG. 9 shows an example of a block diagram of a computing device 114, e.g. a server, configured for the system 100. Computing device 114 may include one or more processors 114A and a system memory 114B. Processor 114A may include a multi-core processor. Computing device 114 may include a memory bus 1300 for communication between the processor 114A and the system memory 114B.

Processor 114A may include but not limited to a microprocessor (μP), a microcontroller (μC), a digital signal processor (DSP), or any combination thereof. Processor 114A may include one more levels of caching, such as a level one cache and a level two cache, two or more processor cores, and registers. Processor core ay include an arithmetic logic unit (ALU), a floating point unit (FPU), a digital signal processor core (DSP Core), or any combination thereof. Processor 114A may include a memory controller 1520. Processor 114A may include a location prediction module configured to facilitate prediction of a location of a given memory address based upon a memory address distribution table of memory addresses stored by the on-chip caches of one or more of the processor cores.

System memory 114B may include but not limited to volatile memory (such as RAM), non-volatile memory (such as ROM, flash memory, etc.) or any combination thereof. System memory 114B may include an operating system 1210, one or more applications 1220, and program data 1230. Application 1220 may be arranged to operate with program data 1230 on the operating system 1210. Application 1220 may include algorithm for the method 1000, the verification module, the activation module, the token module, etc. Program data 1230 may include the key 132, signal list 139, token 130, etc. Computing device 114 may include a bus/interface controller 1400 configured to facilitate communication between the processor 114A/system memory 114B and a data storage device 1600 via the storage interface bus 1500.

As shown in FIG. 9, the data storage devices 1600 may be at least one of removable storage devices 1620 and non-removable storage devices 1640. Removable storage devices 1620 and non-removable storage devices 1640 may include magnetic disk devices such as flexible disk drives and hard-disk drives (HDD), optical disk drives such as compact disk (CD) drives or digital versatile disk (DVD) drives, solid state drives (SSD), and tape drives, etc. Signal list 139, sequence list, activity log 136, etc. may be stored in the data storage devices 1600.

System memory 114B, removable storage devices 1620, non-removable storage devices 1640 are examples of computer storage media. Computer storage media may also include RAM, ROM, EEPROM, flash memory, CD-ROM, optical storage, e.g. DVD, magnetic cassettes, magnetic tape, magnetic disk storage, etc.

Computing device 114 may include various interface devices, e.g. output device 1720, peripheral interfaces 1740, communication devices 1760. Computing device 114 may include an interface bus 1800 configured to facilitate communication between the processor 114A, system memory 114B, storage devices 1600 and the interface devices.

Output devices 1720 may include a graphics processing unit (GPU) 1722 configured to communicate to a display and an audio process unit (APU) 1724 configured to communicate with a speaker via one or more A/V ports 1720.

Peripheral devices 1740 may include a serial interface controller (SIC) 1742 or a parallel interface controller 1744 configured to communicate with external devices such as input devices (e.g., keyboard, mouse, pen, voice input device, touch input device, etc.) or other peripheral devices (e.g., printer, scanner, etc.) via one or more I/O ports 1746.

Communication device 1760 may include a network controller 1762, configured to facilitate communications with one or more other computing devices 1002 over a network communication link via one or more communication ports 1764. For example, the computing device 114 of the first mobile monitoring unit 110A may communicate with computing device 114 of the second mobile monitoring unit 110B.

Network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. For example, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 114 may be a portable (or mobile) electronic device, e.g. a cell phone, a personal data assistant (PDA), a personal media player device, a wireless web-watch device, a personal headset device, an application specific device, or a hybrid device that include any of the above functions. Computing device 114 may also be a personal computer including both laptop computer and non-laptop computer configurations, e.g. desktop.

It should be appreciated that all the information in system database may be maintained in one or more databases or on each of a plurality of databases using distributed database technology. Further, it should be appreciated that the modules may be hosted on one server or a plurality of servers connected via the network.

As shown above, the mobile monitoring system 100 provides a solution in delivering the security and facility monitoring services needed in our advanced global city. Mobile monitoring unit 110 may also be fitted with a drone so that in situations where closer surveillance is needed, the personnel of the mobile monitoring unit 110 can quickly deploy the drone to carry out close monitoring. Such mobile monitoring units 100 may be used to house a robot, in which the robot can attend to dangerous situation such as bomb disposal, so that personnel can carry out the disposal safely. It is also possible to include water vessels in the mobile monitoring unit 110 to provide cross water monitoring operations. In the event of any hostile and dangerous activities, e.g. shooting in a compound, the mobile monitoring unit 110 with its surveillance capability may provide an effective platform for the police units to monitor the situation and carry out rescue operations more accurately and swiftly. In this way, they will be able to save lives. With multiple mobile monitoring units 110 in deployment and with the capability of capturing surveillance data from its monitoring systems, e.g. CCTV installation, in its duster of areas, they can provide a good deterrence to any pre-planned terrorist activities or threats. As such terrorist activities do not happen in an ad-hoc manner, premises that are under constant surveillance can be a deterrence to such activities.

A skilled person would appreciate that the features described in one example may not be restricted to that example and may be combined with any one of the other examples.

The present invention relates to a mobile monitoring system, a mobile monitoring unit and a mobile monitoring method generally as herein described, with reference to and/or illustrated in the accompanying drawings.

The invention claimed is:

1. A mobile monitoring unit adapted to monitor a plurality of premises, the mobile monitoring unit is adapted to receive alarm signals from the plurality of premises and respond to the alarm signals, wherein the mobile monitoring unit is adapted to move to at least one of the plurality of premises, wherein the mobile monitoring unit comprises:

a communication module configured to transmit a takeover instruction to another communication module of another mobile monitoring unit;

a token module configured to receive a token from a precedent mobile monitoring unit and transmit the token to another mobile monitoring unit, the token being configured to store the takeover instruction, wherein the communication module is configured to automatically transmit the token to the another mobile monitoring unit within a pre-determined period of time to circulate the token to the another mobile monitoring unit, wherein the token is configured to transfer the takeover instruction to the another mobile monitoring unit;

wherein, upon receiving the takeover instruction, the another mobile monitoring unit is configured to receive the alarm signals and respond to the alarm signals.

2. The mobile monitoring unit of claim 1, wherein the communication module is configured to receive a verification request from the another mobile monitoring unit to verify the transmission of the takeover instruction, wherein the mobile monitoring unit further may include a verification module configured to verify the verification request from the another mobile monitoring unit.

3. The mobile monitoring unit of claim 1 or 2, wherein the communication module is configured to automatically transmit the token based on a pre-determined set of conditions to be met.

4. The mobile monitoring unit of claim 1, further comprising a token transfer sequence list which records the sequence of transmission between the plurality of mobile monitoring units.

5. The mobile monitoring unit of claim 1, further comprising an activation module configured to process a set of conditions and activate the transmission of the takeover instruction if the set of conditions satisfy a pre-determined set of conditions.

6. The mobile monitoring unit of claim 1, wherein the communication module of the another mobile monitoring unit is configured to receive a set of operational instructions for operating the mobile monitoring unit from the another mobile monitoring unit.

7. The mobile monitoring unit of claim 1, further comprising a control unit configured to immobilise or shut down the mobile monitoring unit after the takeover instruction has been transmitted.

8. A monitoring method for monitoring a plurality of premises, the method comprising:

monitoring the plurality of premises; transmitting a takeover instruction from a mobile monitoring unit to another mobile monitoring unit, wherein the mobile monitoring unit is adapted to receive alarm signals from the at least one premise and responding to the alarm signals by moving to at least one of the plurality of premises;

receiving a token from a precedent mobile monitoring unit and automatically transmitting the token from the mobile monitoring unit to the another mobile monitoring unit within a pre-determined period of time to circulate the token to the another mobile monitoring unit, wherein the token is configured to store the takeover instruction and transfer the takeover instruction to the another mobile monitoring unit;

wherein, upon receiving the takeover instruction, the another mobile monitoring unit is configured to receive the alarm signals and respond to the alarm signals.

9. The method of claim 8, further comprising receiving a verification request from the another mobile monitoring unit to verify the transmission of the key from the mobile monitoring unit.

10. The method of claim 8, wherein the communication module is configured to automatically transmit the token based on a pre-determined set of conditions to be met.

11. The method of claim 8, further comprising a token transfer sequence list which records the sequence of transmission between the plurality of mobile monitoring units.

12. The method of claim 8, further comprising processing a set of pre-determined conditions and activating, based on the set of predetermined conditions, the transmission of the takeover instruction.

13. The method of claim 8, further comprising receiving a set of operational instructions for operating the mobile monitoring unit from the another mobile monitoring unit.

14. The method of claim 8, further comprising immobilising or shutting down the mobile monitoring unit after transmitting the takeover instruction.

15. A mobile monitoring system adapted to monitor a plurality of premises, the system comprising:

a plurality of mobile monitoring units adapted to monitor the plurality of premises, each of the plurality of mobile monitoring units is adapted to receive alarm signals from the plurality of premises and respond to the alarm signals by moving to at least one of the plurality of premises, wherein a first mobile monitoring unit of the plurality of mobile monitoring units is adapted to transmit a takeover instruction to a second mobile monitoring unit of the plurality of mobile monitoring units, wherein the plurality of mobile control units are configured to circulate the token between each other, wherein the plurality of mobile control units automatically transmit a token from one of the plurality of mobile monitoring units to another within a pre-determined period of time, wherein the token is configured to store the takeover instruction from the first mobile monitoring unit and transfer the takeover instruction to the second mobile monitoring unit;

wherein upon receiving the takeover instruction, the second mobile monitoring unit is configured to receive the alarm signals and respond to the alarm signals.

16. The mobile monitoring system of claim 15, wherein the second mobile monitoring unit is configured to transmit a verification request to the first mobile monitoring unit to verify the transmission of the takeover instruction from the first mobile monitoring unit.

17. The mobile monitoring system of claim 15, wherein the communication module is configured to automatically transmit the token based on a pre-determined set of conditions to be met.

18. The mobile monitoring system of claim 15, wherein each of the plurality of mobile monitoring units further comprises a token transfer sequence list which records the sequence of transmission between the plurality of mobile monitoring units.

19. The mobile monitoring system of claim 15, wherein the first mobile monitoring unit is configured to receive a set of operational instructions for operating the mobile monitoring unit from the second mobile monitoring unit.

20. The mobile monitoring system of claim 15, wherein the first mobile monitoring unit is configured to be immobilised or shut down after the takeover instruction has been transmitted.

* * * * *